US005234206A

United States Patent [19]

Shih

[11] Patent Number: 5,234,206

[45] Date of Patent: Aug. 10, 1993

[54] CLAMPING APPARATUS OF CONSTRUCTION MOLDING BOARD

[76] Inventor: L. G. Shih, No. 41, Alley 42, Lane 46-12, Tuo Cheng Rd., Tali Hsian, Taichung Hsien, Taiwan

[21] Appl. No.: 2,053

[22] Filed: Jan. 8, 1993

[51] Int. Cl.[5] ..... B25B 1/08

[52] U.S. Cl. ..... 269/231; 269/236; 269/904; 249/219.1

[58] Field of Search ..... 249/190, 213, 216, 270, 249/219.1, 219.2, 40, 43, 44, 45, 46; 269/204, 231, 235, 236, 904; 254/254 R, 29 A

[56] References Cited

U.S. PATENT DOCUMENTS

| | | | |
|---|---|---|---|
| 2,672,839 | 3/1954 | Neuhaus | 269/231 |
| 2,964,294 | 12/1960 | Imonetti | 269/231 |
| 3,202,419 | 8/1965 | Nansel | 269/236 |
| 4,726,560 | 2/1988 | Dotson | 254/29 A |

FOREIGN PATENT DOCUMENTS

| | | | |
|---|---|---|---|
| 1957315 | 11/1969 | Fed. Rep. of Germany | 249/219.1 |

*Primary Examiner*—Robert C. Watson

*Attorney, Agent, or Firm*—Browdy and Neimark

[57] ABSTRACT

A clamping apparatus of construction molding board has a base, a base body, a press bar, and a torsion spring. The base is provided with a through hole. The base body of U-shaped construction is made integrally with the base such that the base body extends upwards from the base. The base body contains a receiving space having a rear portion provided with a canal in communication with the through hole of the base. The press bar has a bottom end provided thereon with a serrated arresting portion. The press bar is mounted pivotally in the receiving space by a shaft pin in such a manner that the arresting portion is opposite in location to the canal. The torsion spring is composed of two ring bodies sharing a common end which forms a pressing portion of an inverted U shape. The two ring bodies are provided respectively with another end which forms a supporting portion. The torsion spring is mounted in the receiving space such that the two ring bodies are fitted over the shaft pin, and that the pressing portion embraces the press bar, and further that the two supporting portions are sustained at a predetermined location.

7 Claims, 4 Drawing Sheets

CLAMPING APPARATUS OF CONSTRUCTION MOLDING BOARD

BACKGROUND OF THE INVENTION

The present invention relates to a clamping apparatus of construction molding board, which possesses excellent mechanical properties and can be easily assembled, so as to reduce the overall cost of a construction project.

As shown in FIGS. 1 and 2, a clamping apparatus 10 of the prior art comprises a base 12, a base body 14, a press bar 22, and a torsion spring 24. The base 12 and the base body 14 are integrally made. The base body 14 is U-shaped in its cross section and provided therein with a receiving space 16 and a canal 18 which is located at the rear end of the base body 14 and in communication with a round hole 13 of the base 12. In addition, the base body 14 is composed of two tongues 20 located at the front end thereof. The press bar 22 is pivotally mounted in the receiving space 16 by means of a shaft pin and is provided at the bottom edge thereof with a serrated arresting portion 21, as shown in FIG. 5. The arresting portion 21 is opposite to the canal 18. The torsion spring 24 has a body 25 pivoted to the tongues 20 by a shaft pin 26. The torsion spring 24 has one end forming a hook 27 urging the press bar 22 and another end which urges the base 12. The torsion spring 24 is used to provide the press bar 22 with an arresting force. In operation, the base 12 of the clamping apparatus 10 is placed on a construction molding board 28, as shown in FIG. 3, such that a reinforcing steel 29 passing through the molding board 28 is arranged in the round hole 13 and the canal 18 and that the reinforcing steel 29 is urged by the arresting portion 21 of the press bar 22. Similarly, another clamping apparatus 10 is used to hold another end of the reinforcing steel 29 and another molding board 28.

The clamping apparatus 10 of the prior art described above has several shortcomings, which are elucidated hereinafter.

The torsion spring 24 has one end urging the press bar 22 and another end urging the base 12. These two ends of the torsion spring 24 form a single line thrust, which often results in a greater stress and strain. As a result, the strength and the service life span of the torsion spring 24 are greatly undermined. In addition, these two ends of the torsion spring 24 are situated at the two sides of the body 25, thereby bringing about the couple of forces causing an angular displacement of these two ends at such time when the torsion spring 24 is exerted upon by a force. Such a situation can often lead to the deviation of the press bar 22 from its position.

The press bar 22 and the torsion spring 24 are respectively pivoted to the base body 14 and the tongues 20 by means of the shaft pins 23 and 26, thereby making the manufacturing process of the clamping apparatus 10 rather cumbersome and costly.

The overall material cost of the clamping apparatus is relatively high in view of the fact that the base body 14 is provided with two tongues 20 for mounting the torsion spring 24 and that two shaft pins 23 and 26 are used to fasten the press bar 22 and the torsion spring 24.

In using the clamping apparatus 10 of the prior art, one must hold securely with one hand the base 12 and pull or tug with another hand at the press bar 22 so as to fasten or unfasten the reinforcing steel 29. It is therefore difficult for a worker to use the prior art clamping apparatus 10.

As shown in FIG. 2, the clamping apparatus 10 has two depressed side walls 14*a* serving to keep the press bar 22 at bay so that the press bar 22 does not sway on the shaft pin 23. Therefore, the space between the press bar 22 and the base body 14 can be filled accidentally with the cement mortar. The filled cement mortar can not be easily removed manually from the space that is relatively narrow. The operation of the press bar 22 is therefore hampered.

As shown in FIG. 3 illustrating the clamping apparatus 10 in use, the molding board 28 is under a considerable pressure exerting thereon by the filled cement mortar, thereby causing the serrated arresting portion 21 of the press bar 22 to hold the reinforcing steel 29 tightly. Therefore, it is often necessary that a hammer is used to hit the press bar 22 to break up the intimate association of the serrated arresting portion 21 with the reinforcing steel 29 so as to remove the clamping apparatus 10. In addition, the action of hitting the press bar 22 with a hammer can often bring about a damage to the serrated arresting portion 21 and run the risk of hitting accidentally the hook 27. The torsion spring 24 is made of a high carbon steel material and can be therefore ruptured easily by such an accidental mishap.

As shown in FIG. 4, the torsion spring 24 is composed of a rather lengthy portion between the hook 27 and the body 25 and of an irregularly wound portion. Therefore, the torsion spring 24 is vulnerable to a mechanical fatigue and a failure to urge the press bar 22 to restore its position.

When the clamping apparatus 10 is accidentally impacted, the hook 27 of the torsion spring 24 can become detached to fall on the ground.

As shown in FIG. 5, the reinforcing steel 29 is not held securely in the canal 18 by the arresting portion 21 because the cross section of the reinforcing steel 29 is shown to be held at only two points.

SUMMARY OF THE INVENTION

It is, therefore the primary objective of the present invention to provide a clamping apparatus of construction molding board with excellent mechanical property and stability.

It is another objective of the present invention to provide a clamping apparatus of construction molding board, which can be produced at a low cost It is still another objective of the present invention to provide a clamping apparatus of construction molding board, which is easy to use.

It is still another objective of the present invention to provide a clamping apparatus of construction molding board with a considerable clearance between the press bar and the base body to facilitate the removal of the cement mortar deposit.

It is still another objective of the present invention to provide a clamping apparatus of construction molding board, which can be easily removed without being damaged upon completion of the operation of filling the cement mortar.

It is still another objective of the present invention to provide a clamping apparatus of construction molding board with means preventing the hook of the torsion spring from becoming detached from the press bar.

In keeping with the principles of the present invention, the foregoing objectives of the present invention are attained by a clamping apparatus of construction molding board, which comprises a base, a base body, a press bar, and a torsion spring. The base is provided with a through hole. The base body is U-shaped in its cross section and extends upwards from the base. The base body is provided with a upwards from the base. The base body is provided with a receiving space and a canal in communication with the through hole. The press bar has a serrated arresting portion and is mounted in the receiving space by means of a shaft pin such that the arresting portion is opposite to the canal. The torsion spring is mounted between the base and the base body for providing the press bar with a force. The clamping apparatus of the present invention is characterized in that the torsion spring is composed of two ring bodies sharing a common end portion which forms a pressing portion of an inverted U shape. Each of the two ring bodies has another end forming a supporting portion. The torsion spring is mounted in the receiving space such that its two ring bodies are fitted over the shaft pin supporting the press and its pressing portion presses the press bar. The two supporting portions are parallel to each other and are used to support a predetermined portion of the clamping apparatus.

The torsion spring of the clamping apparatus of the present invention possesses an excellent mechanical property capable of preventing the press bar from moving aside. The torsion spring and the press bare share a common shaft pin, thereby simplifying the process of assembling the clamping apparatus. The pressing portion of the torsion spring is held by the press bar and is therefore not vulnerable to becoming detached.

The foregoing objectives, features are functions of the present invention will be better understood by studying the following detailed description of a preferred embodiment of the present invention in conjunction with the drawings provided herewith.

DETAILED DESCRIPTION OF THE PREFERRED EMBODIMENT

Figure 6:
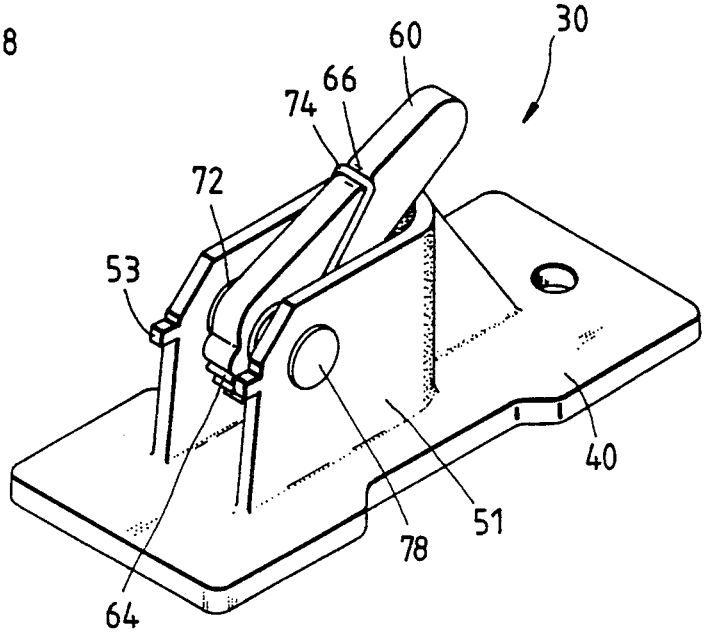
FIG. 6 shows a perspective view a clamping apparatus in combination, according to the present invention.
Figure 7:
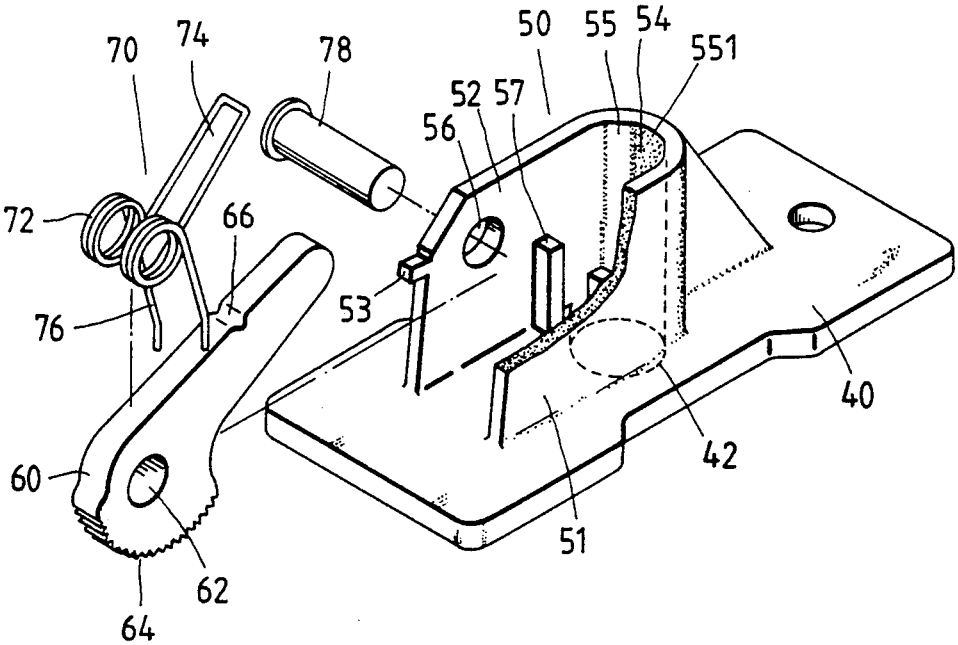
FIG. 7 shows a partial exploded view of the clamping apparatus as shown in FIG. 6.
Figure 8:
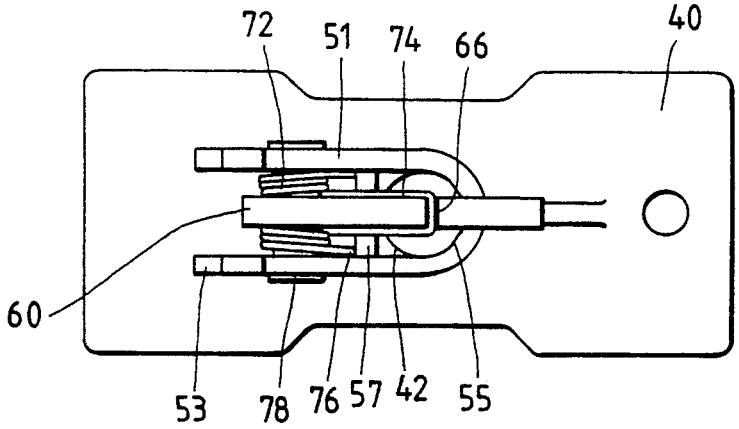
FIG. 8 shows a top view of the clamping apparatus as shown in FIG. 6.

Referring to FIGS. 6, 7 and 8, a clamping apparatus 30 of the present invention is shown to comprise the structures described hereinafter.

A base 40 of rectangular shape has a through hole 42.

A base body 50 is U-shaped in its cross section. The base body 50 is made integrally with the base 40 in such a manner that the base body 50 extends upwards from the base 40. The base body 50 has two front ends, each of which is provided thereon with a locating portion 53, a receiving space 52 and a canal 54 in communication with the through hole 42 of the base 40. The inner wall waking up the canal 54 is provided with two bevels 55 located by both sides of a center line of the longitudinal axis of the base body 50. Located between the two bevels 55 is an arcuate portion 551. Two front walls 51 of the base body 50 are provided respectively with a horizontal through hole 56. The two front walls 51 are spaced appropriately. Located on the wall between each of the two horizontal through holes 56 and the canal 54 is a protruded upright column 57.

A press bar 60 is provided at the front end thereof with a pivoting hole 62. The bottom edge of the front end of the press bar 60 is so serrated as to form an arresting portion 64 while the top surface of the rear end of the press bar is provided thereon with a slot 66. The press bar 60 is mounted in the receiving space 52 in such a manner that the press bar 60 is so restrained by the two upright columns 57 from swaying and that the arresting portion 64 is corresponding in location to the canal 54 of the base body 50.

A torsion spring 70 is composed of two ring bodies 72, which share a common end forming a pressing portion 74 of an inverted U shape. Each of the two ring bodies 72 has another end forming a supporting portion 76. These two supporting portions 76 are parallel to each other. The torsion spring 70 is mounted in the receiving space 52. A shaft pin 78 is mounted in the two horizontal through holes 56 of the base body 50 and is fitted into the two ring bodies 72 of the torsion spring 70. In addition, the shaft pin 78 is fitted into the pivoting hole 62 of the press bar 60 such that the press bar 60 is sandwiched between the two ring bodies 72 and that the pressing portion 74 presses the press bar 60, with the top end of the pressing portion 74 being received in the slot 66 of the press bar 60 and with the two supporting portions 76 urging the two upright columns 57. The torsion spring 70 serves as the source of a force exerting on the press bar 60 so that the arresting portion 64 of the press bar 60 is forced deeply into the canal 54.

Figure 9:
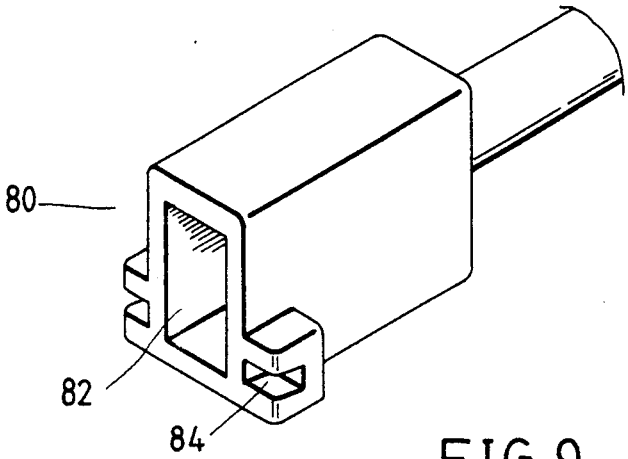
FIG. 9 shows a perspective view of a tool designed specifically for use in conjunction with the clamping apparatus of the present invention.
Figure 10:
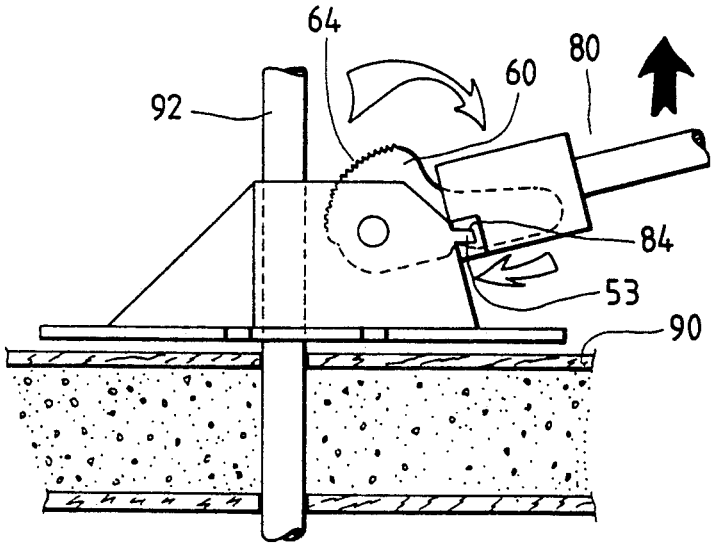
FIG. 10 is a schematic view showing that the clamping apparatus of the present invention is in action in conjunction with the tool as shown in FIG. 9.
Figure 11:
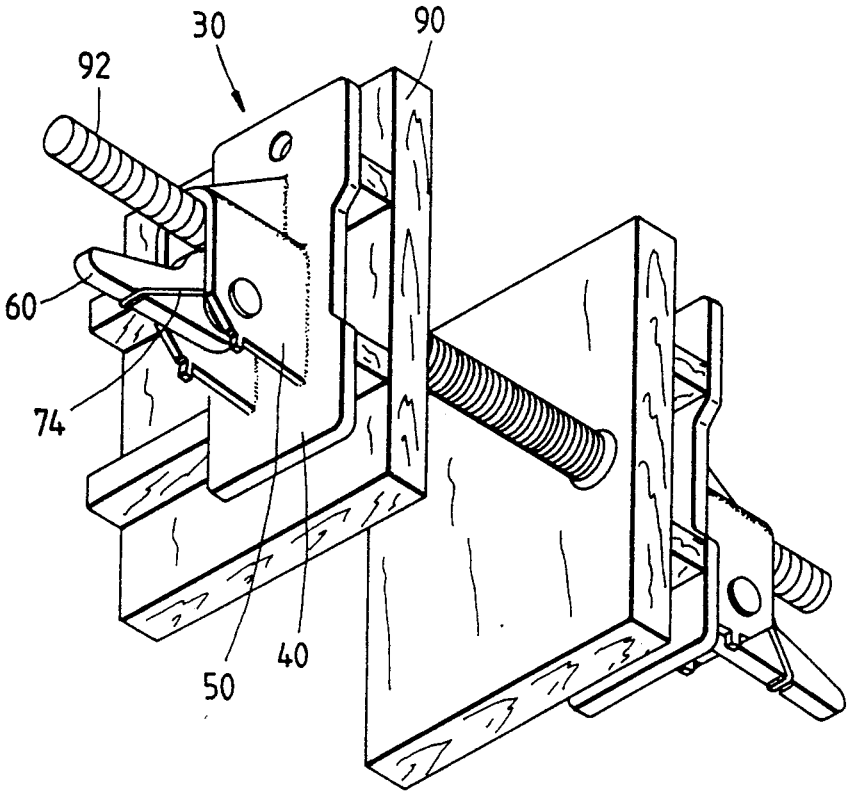
FIG. 11 is a schematic view showing that the construction molding board is braced by the clamping apparatus of the present invention.

The operation of the clamping apparatus 30 of the present invention is illustrated in FIGS. 9 and 10, which the apparatus 30 is shown to work in conjunction with a tool 80 which is developed by this applicant. The tool 80 has a fitting hole 82 so dimensioned as to fit over the top edge of the press bar 60, which is then caused to move in such a way that the arresting portion 64 moves out of the canal 54. The tool 80 is additionally provided with two retaining portions 84 so dimensioned to fit over the two locating portions 53. Therefore, the press bar 60 can be located by fitting the two retaining portions 84 of the tool 80 over the two locating portions 53 of the base body 50. After the press bar 60 has been so located, allow an end of a reinforcing steel bar 92 passing through two construction molding boards 90 to be lodged in the canal 54 via the through hole 42 of the base 40. The tool 80 can be removed as soon as the base 40 of the apparatus 30 is placed on the molding board 90. The arresting portion 64 actuates the spring 70 to keep the steel bar 92 in the canal 54. Therefore, two molding boards 90 can be fastened respectively to both ends of the steel bar 92 by means of two clamping apparatus 30, as shown in FIG. 11.

Upon completion of the operation of filling the space between the two molding boards 90 with the cement motor, the two clamping apparatus 30 can be then removed by using the tool 80, which is again fitted over the press bar 60. With the help of the tool 80, a worker can easily wrench the press bar 60 to bring about a termination of the intimate association of the arresting portion 64 and the steel bar 92. As a result, the clamping apparatus 30 can be removed.

The clamping apparatus 30 of the present invention has advantages over the prior art clamping apparatus, which are further expounded hereinafter.

The torsion spring 70 is so constructed as to have a structure of dual line symmetry. As a result, the torsion spring 70 is under less stress and strain when exerted on by a force. For this reason, the torsion spring 70 is able to provide the press bar 60 with a force greater than that provided by the torsion spring of the prior art clamping apparatus. In addition, the torsion spring 70 is of a symmetrical construction and therefore has a relatively stable moment of force when exerted on by a force. In other words, an incident of angular displacement of the torsion spring 70 is effectively avoided. Therefore, the press bar 60 can not be caused to move aside.

The clamping apparatus 30 of the present invention is used in conjunction with the tool 80 which is employed as a lever to help locate the press bar 60. Such a maneuver improves the operational efficiency.

With the help of the tool 80, a worker can easily set the clamping apparatus 30 free without using a hammer and without running the risk of damaging the clamping apparatus 30.

The press bar 60 and the torsion spring 70 share a common shaft pin 78. As a result, the process of making the clamping apparatus 30 is substantially simplified and economized.

Figure 2:
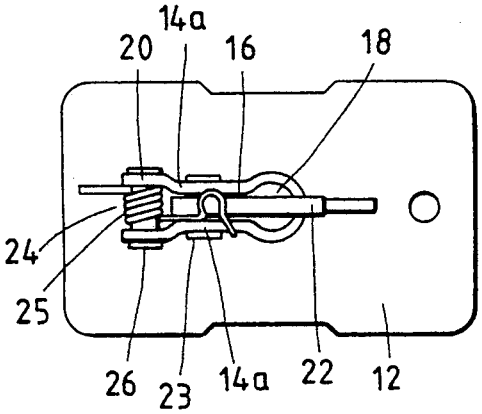
FIG.2 PRIOR ART
FIG. 2 shows a top view of the clamping apparatus as shown in FIG. 1.
Figure 1:
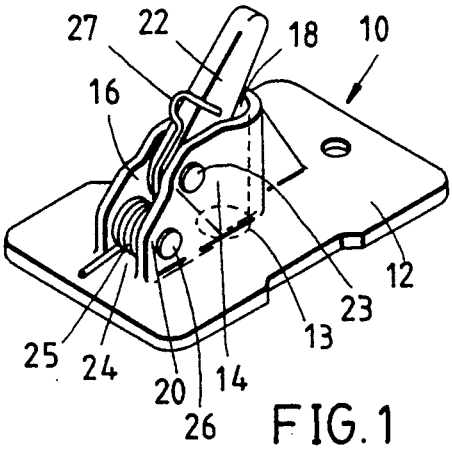
FIG.1 PRIOR ART
FIG. 1 shows a perspective view of a clamping apparatus of construction molding board of the prior art.
Figure 3:
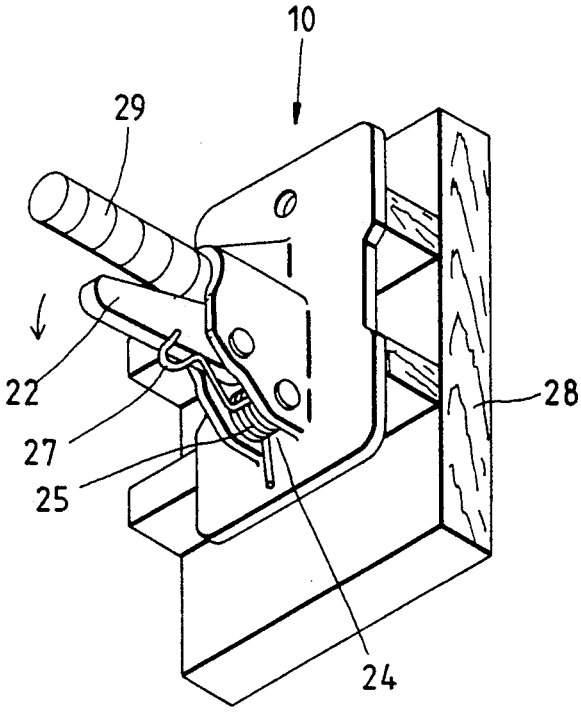
FIG.3 PRIOR ART
FIG. 3 is a schematic view showing that the prior art camping apparatus, as shown in FIG. 1, is at work.
Figure 4:
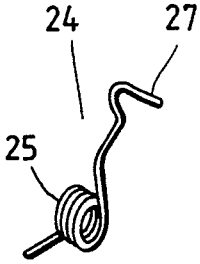
FIG.4 PRIOR ART
FIG. 4 shows a perspective view of a torsion spring of the prior art clamping apparatus as shown in FIG. 1.
Figure 5:
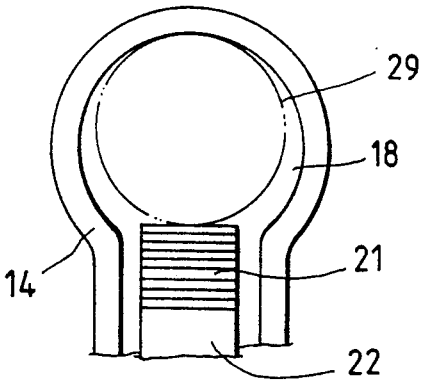
FIG. 5 PRIOR ART
FIG. 5 is a schematic view showing that a reinforcing steel bar is braced by the prior art clamping apparatus.

By comparison, the base body 50 of the present invention is devoid of two tongues 20 of the prior art apparatus 10, as shown in FIG. 1. This means that the material cost of the present invention is relatively lower than that of the prior art.

The base body 50 of the present invention is provided with the two protruded upright columns 57, which serve effectively to prevent the press bar 60 from moving aside. In addition, the press bar 60 is effectively refrained from moving aside by the two ring bodies 72 of the torsion spring 70.

There is a considerable clearance between the base body 50 and the press bar 60 of the present invention. As a result, any cement mortar deposited between the base body 50 and the press bar 60 can be easily removed therefrom.

The pressing portion 74 of the torsion spring 70 of the present invention embraces the press bar 60 in such a manner that the top of the pressing portion 74 is received in the slot 66 provided on the press bar 60. Therefore, the torsion spring 70 can not be ruptured accidentally or caused to fall when the clamping apparatus 30 of the present invention is impacted.

Figure 12:
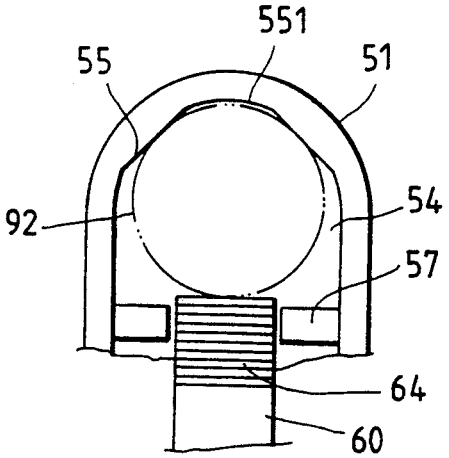
FIG. 12 is a schematic view showing that a reinforcing steel bar is braced by the clamping apparatus of the present invention.

As shown in FIG. 12, the steel bar 92 is braced securely at three points by the two bevels 55 and the arresting portion 64. If the steel bar 92 having a predetermined diameter is used, the steel bar 92 can be braced at four points by the arresting portion 64, two bevels 55, and the arcuate portion 551.

The pressing portion 74 of the torsion spring 70 possesses an excellent mechanical property and is therefore less vulnerable to a mechanical fatigue, thereby making sure that the press bar 60 is always provided with a force sufficient to restore its appropriate position.

What is claimed is:

1. A clamping apparatus of construction molding board comprising:

(a) a base provided with a through hole;

(b) a base body made integrally with said base in such a manner that said base body extends upwards from said base and that said base body contains therein a receiving space provided with a canal in communication with said through hole of said base;

(c) a press bar having a bottom end mounted pivotally in said receiving space by means of a shaft pin and provided thereon with a serrated arresting portion opposite in location to said canal;

(d) a torsion spring mounted between said base and said base body for pushing said arresting portion of said press bar deep into said canal; and wherein said torsion spring is composed of two ring bodies sharing a common end which forms a pressing portion of an inverted U shape, said two ring bodies having another ends parallel to each other to form a supporting portion, said torsion spring being mounted in said receiving space in such a manner that said two ring bodies are fitted over said shaft pin, and that said press bar is sandwiched between said two ring bodies, and further that said pressing portion embraces said press bar while said supporting portion urges a predetermined portion.

2. The clamping apparatus of construction molding board according to claim 1 wherein said base body has two inner walls provided respectively with a protruded upright column located between said receiving space and said canal for restraining said press bar and for sustaining said supporting portion of said torsion spring.

3. The clamping apparatus of construction molding board according to claim 1 wherein said base body has two front ends provided respectively with a locating portion.

4. The clamping apparatus of construction molding board according to claim 1 wherein said press bar has an upper surface provided thereon with a slot for receiving therein said pressing portion of said torsion spring.

5. The clamping apparatus of construction molding board according to claim 1 wherein said canal of said base body has an inner wall provided with two bevels located respectively on both sides of a center line of a longitudinal axis of said base body.

6. The clamping apparatus of construction molding board according to claim 1 wherein said base body is composed of two front walls of a length, which are spaced equidistantly throughout the entire length of said two front walls.

7. The clamping apparatus of construction molding board according to claim 5 wherein said inner wall of said canal comprises an arcuate portion bridging said two bevels.

* * * * *